US009133611B2

(12) United States Patent
Plugovoy

(10) Patent No.: US 9,133,611 B2
(45) Date of Patent: Sep. 15, 2015

(54) TOILET VENTILATION SYSTEMS

(71) Applicant: Yevgeniy Plugovoy, Sacramento, CA (US)

(72) Inventor: Yevgeniy Plugovoy, Sacramento, CA (US)

( * ) Notice: Subject to any disclaimer, the term of this patent is extended or adjusted under 35 U.S.C. 154(b) by 402 days.

(21) Appl. No.: 13/717,742

(22) Filed: Dec. 18, 2012

(65) Prior Publication Data

US 2014/0165279 A1 Jun. 19, 2014

(51) Int. Cl.
*E03D 9/04* (2006.01)
*E03D 9/05* (2006.01)

(52) U.S. Cl.
CPC ... *E03D 9/05* (2013.01); *E03D 9/04* (2013.01)

(58) Field of Classification Search
CPC ..... E03D 9/04; E03D 9/05; E03D 9/052
USPC ..... 4/213, 216, 218, 347–349
See application file for complete search history.

(56) References Cited

U.S. PATENT DOCUMENTS

| | | | | |
|---|---|---|---|---|
| 5,029,346 | A | 7/1991 | Fernald, Sr. | |
| 5,305,472 | A | 4/1994 | Eger | |
| 6,397,407 | B1 | 6/2002 | Dahlberg | |
| 2011/0088156 | A1 * | 4/2011 | White | 4/348 |

* cited by examiner

*Primary Examiner* — Tuan N Nguyen
(74) *Attorney, Agent, or Firm* — Georgiy L. Khayet

(57) ABSTRACT

Provided are toilet ventilation systems. A toilet ventilation system may use an air conduit to facilitate removal of air from a toilet bowl into a toilet tank via an overflow tube. The air conduit may connect the toilet tank and a ventilation fan. The toilet ventilation system may include a ventilation valve coupled to the air conduit and configured to open into a room environment. The ventilation valve may be coupled to a flush handle via a ventilation valve connector. Engaging the flush handle may open the ventilation valve into the room environment. The toilet ventilation system may also include a drainage connector configured to couple the flush handle to the overflow tube that may be connected to the toilet bowl via a drainage tube.

10 Claims, 8 Drawing Sheets

TOILET VENTILATION SYSTEMS

FIELD

This application relates generally to ventilated toilet systems and, more specifically, to ventilated toilet systems using a ventilation valve.

BACKGROUND

Ventilation is the process of "changing" or replacing air in any space to provide high indoor air quality (i.e. to control temperature, replenish oxygen, or remove moisture, odors, smoke, heat, dust, airborne bacteria, and carbon dioxide). Ventilation is used to remove unpleasant smells and excessive moisture, introduce outside air, to keep interior building air circulating, and to prevent stagnation of the interior air. Ventilation during toilet use is especially critical, since during the toilet use, odors from a toilet bowl and air born bacteria may enter an immediate atmosphere. Not only these odors and bacteria may be undesirable to a toilet user but they may also be dangerous to the user. Facility ventilation systems such as bathroom vents may help to address some of these problems but they still expose the user to the odors and bacteria and further spread these bacteria and odors in the environment. Local ventilation systems installed on the toilets are expensive and may be contaminated during their use.

Besides, traditional ventilation systems may have a complicated structure that oftentimes does not provide for a single build-in ventilation valve that would allow for air flow into a toilet tank and for toilet flushing.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Provided are toilet ventilation systems. In general, these toilet ventilation systems are designed to facilitate toilet ventilation and flushing processes.

According to the toilet ventilation systems disclosed herein, a toilet ventilation system may include an air conduit configured to facilitate removal of air from a toilet bowl into a toilet tank via an overflow tube that may be connected to the toilet bowl via a drainage tube. The air conduit may be coupled to the toilet tank and a ventilation van. Furthermore, the air conduit may be operatively coupled to a ventilation valve configured to open into a room environment. The toilet ventilation system may also include a ventilation valve connector configured to rigidly couple the ventilation valve to a flush handle. When engaging the flush handle, the ventilation valve connector may open the ventilation valve into the room environment. Opening of the ventilation valve may cause a pause in the removal of the air from the toilet bowl.

In certain embodiments, the toilet ventilation system may also include a drainage connector configured to operatively couple the flush handle to the overflow tube.

DETAILED DESCRIPTION OF EXAMPLE EMBODIMENTS

The following detailed description includes references to the accompanying drawings, which form a part of the detailed description. The drawings show illustrations, in accordance with example embodiments. These example embodiments are described in enough detail to enable those skilled in the art to practice the present subject matter.

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific embodiments, it will be understood that these embodiments are not intended to be limiting.

In this document, the terms "a" or "an" are used, as is common in patent documents, to include one or more than one. In this document, the term "or" is used to refer to a nonexclusive "or", such that "A or B" includes "A but not B", "B but not A", and "A and B", unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

A system described herein represents a toilet ventilation system with a build-in ventilation valve with dual utility. The ventilation valve may be coupled to an air conduit configured to connect a toilet tank and a ventilation fan. During flushing of a toilet bowl, the ventilation fan may be on and the air drawn by the ventilation fan may enter from a room environment. To flush the toilet bowl, a flush handle may be engaged. The flush handle may be operatively coupled to the ventilation valve and a drainage valve. Engaging the flush handle may first open the ventilation valve into the room environment and the air may flow to the toilet tank from the room environment. When further engaging the flush handle, the drainage valve may be lifted above a drainage tube, thereby allowing water to flow from the toilet tank to the toilet bowl through the openings in the toilet bowl.

Figure 1:
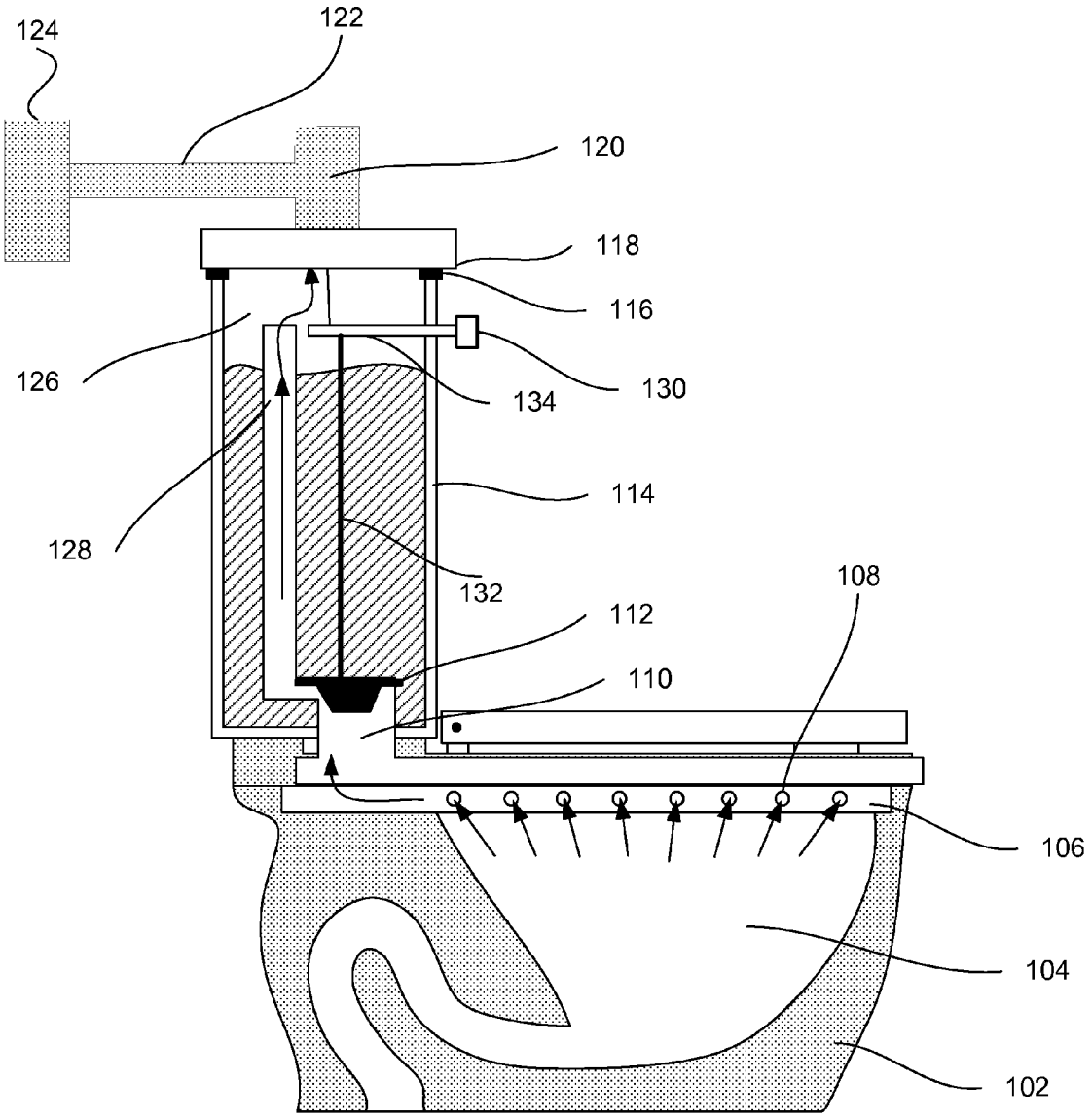
FIG. 1 is a schematic illustration of a ventilated toilet system with a ventilation valve during ventilation of its bowl cavity, in accordance with certain embodiments.

Referring now to figures, FIG. 1 is a schematic illustration of a ventilated toilet system with a ventilation valve during ventilation of its bowl cavity, in accordance with certain embodiments. A ventilated toilet system includes several components such as a toilet bowl 102, a toilet tank 114, a ventilation valve 120, an air conduit 122, and a ventilation fan 124. The toilet bowl 102 may be used for supporting other components of the ventilated toilet system and for collecting waste and waste water and directing this waste and waste water through a closet bend to a sewer line. The toilet bowl 102 may be positioned on and secured to the floor of the building structure and sealed with a wax ring to the closet bend. The toilet bowl 102 may have a water trap to prevent odors from the sewage system from entering a bowl cavity 104. Furthermore, the toilet bowl 102 may include a flush passage 106 for supplying water into the bowl cavity 104 and for exhausting air from the bowl cavity 104. More specifically, the flush passage 106 has one or more openings 108 open to an environment and directed to the bowl cavity 104 for flushing water into the bowl cavity 104 and ventilating the bowl cavity 104.

The toilet tank 114 may be attached to the toilet bowl 102 and is used for collecting and storing water used for flushing the bowl cavity 104. In certain embodiments, the toilet tank 114 and the toilet bowl 102 may be integrated into one piece. However, in other embodiments, the toilet tank 114 and the toilet bowl 102 may be separate components. The toilet tank 114 may include a drainage valve 112 positioned on a drainage tube 110 for controlling supply of water into the bowl cavity 104 or, more specifically, into the flush passage 106 and then through the one or more openings 108 into the bowl cavity 104. The drainage valve 112 may be attached to one or more overflow tubes 128 vertically extending in the toilet tank 114. The one or more overflow tubes 128 may be connected to the toilet bowl 102 via the drainage tube 110. The drainage tube 110 may in turn be connected to the toilet bowl 102 via an opening in the toilet bowl 102. A position of the drainage valve 112 may be controlled, for example, by a flush handle 130 through a trip lever 134 and a chain 132. However, other flushing mechanisms are also within the scope of this description. Some of these components are not shown in FIG. 1 for clarity.

In certain embodiments, the ventilation valve 120 may include a drainage connector (not shown) configured to operatively couple the flush handle 130 to the one or more overflow tubes 128.

An upper end of the one or more overflow tubes 128 may be positioned above the predetermined water level in the tank when the toilet functions properly. In this scenario, the predetermined water level may be controlled by a combination of a float and a fill valve. The float may rise together with the water level when the toilet tank 114 is filled with water and the water reaches a predetermined level, it triggers the fill valve, which in turn shuts the supply of the water into the tank. The one or more overflow tubes 128 may prevent water spills out of the toilet tank 114 when the float and/or the fill valve malfunctions and allows the water to go above the predetermined level. In these rare situations, the water may reach the upper end of the one or more overflow tubes 128 and may be then diverted into the flush passage 106 and eventually into the bowl cavity 104. However, most of the time, the one or more overflow tubes 128 remain free of water.

The toilet tank 114 may also include a tank cover 118 that may seal an interior 116 of the toilet tank 114 from the environment. In certain embodiments, an interface of side walls of the toilet tank 114 and the tank cover 118 may include a seal, such as a rubber gasket or a bead of silicone sealing material. In other embodiments, the seal between the side walls of the toilet tank 114 and the tank cover 118 may be provided by a tight fit of the surfaces. Generally, some air flow may be allowed through an interface of the side walls of the toilet tank 114 and the tank cover 118 as long as this air flow is substantially less than the air flow through the one or more overflow tubes 128.

The tank cover 118 may have an opening (not shown) for attaching the ventilation valve 120 that may be configured to open into a room environment so that during flushing of the toilet bowl 102, the air may be supplied from the room environment instead of the one or more overflow tubes 128 of the toilet tank 114. One end of the ventilation valve 120 may be coupled to the air conduit 122. The air conduit 122 may be configured to connect the toilet tank 114 and the ventilation fan 124. Furthermore, the air conduit 122 may be configured to facilitate removal of air from the toilet bowl 102 moved into the toilet tank 114 via the one or more overflow tubes 128.

The ventilation fan 124 may create an air flow through the one or more overflow tubes 128 and the flush passage 106 and may draw air into the one or more openings 108 of the flush passage 106 when the ventilation valve 120 is closed. This air flow may effectively ventilate the bowl cavity 104 from undesirable odors. It should be noted that the air conduit 122, the one or more overflow tubes 128, the flush passage 106, and the bowl cavity 104 form an air flow channel at least when the toilet is not being flushed and when the ventilation valve 122 is closed. Therefore, ventilation of the bowl cavity 104 may be performed before flushing of the toilet, e.g., when a user discharges his or her waste into the bowl cavity 104 and odor is generated and may enter the environment, and after flushing, when some odor may remain in the environment.

In certain embodiments, the ventilation fan 124 may be enclosed in a housing (not shown), which may be attached to the tank cover 118. The housing may be equipped with electrical wiring for powering the ventilation fan 124. In certain embodiments, the housing may include a switch and/or components for operating the ventilation fan 124. These components may be used for turning the ventilation fan 124 on and off and, in certain embodiments, control the speed of the ventilation fan 124. For example, the ventilation fan 124 may operate at a higher speed when a user discharges his or her waste into the bowl cavity 104 and at a lower speed after flushing the toilet in order to remove the remaining odor from the environment. The housing may also have ventilation connection for directing the exhaust of the ventilation fan 124. In certain embodiments, the ventilation fan 124 may also include a build-in exhaust fan. In certain embodiments, the ventilated toilet system may be equipped with a filter for cleaning the air removed from the bowl 102. The filter may also be configured to filter exhaust of the ventilation fan 124 and return the exhausted air into the environment.

In certain embodiments, the ventilation fan 124 may be turned on based on a proximity sensor sending a user within a predetermined distance.

While FIG. 1 illustrates the ventilated toilet system during ventilation of the bowl cavity 104 through the air conduit 122, the one or more overflow tubes 128, and the flush passage 106, the same system and some of these components may be used for flushing the bowl cavity 104 as further explained with reference to FIG. 2.

Figure 2:
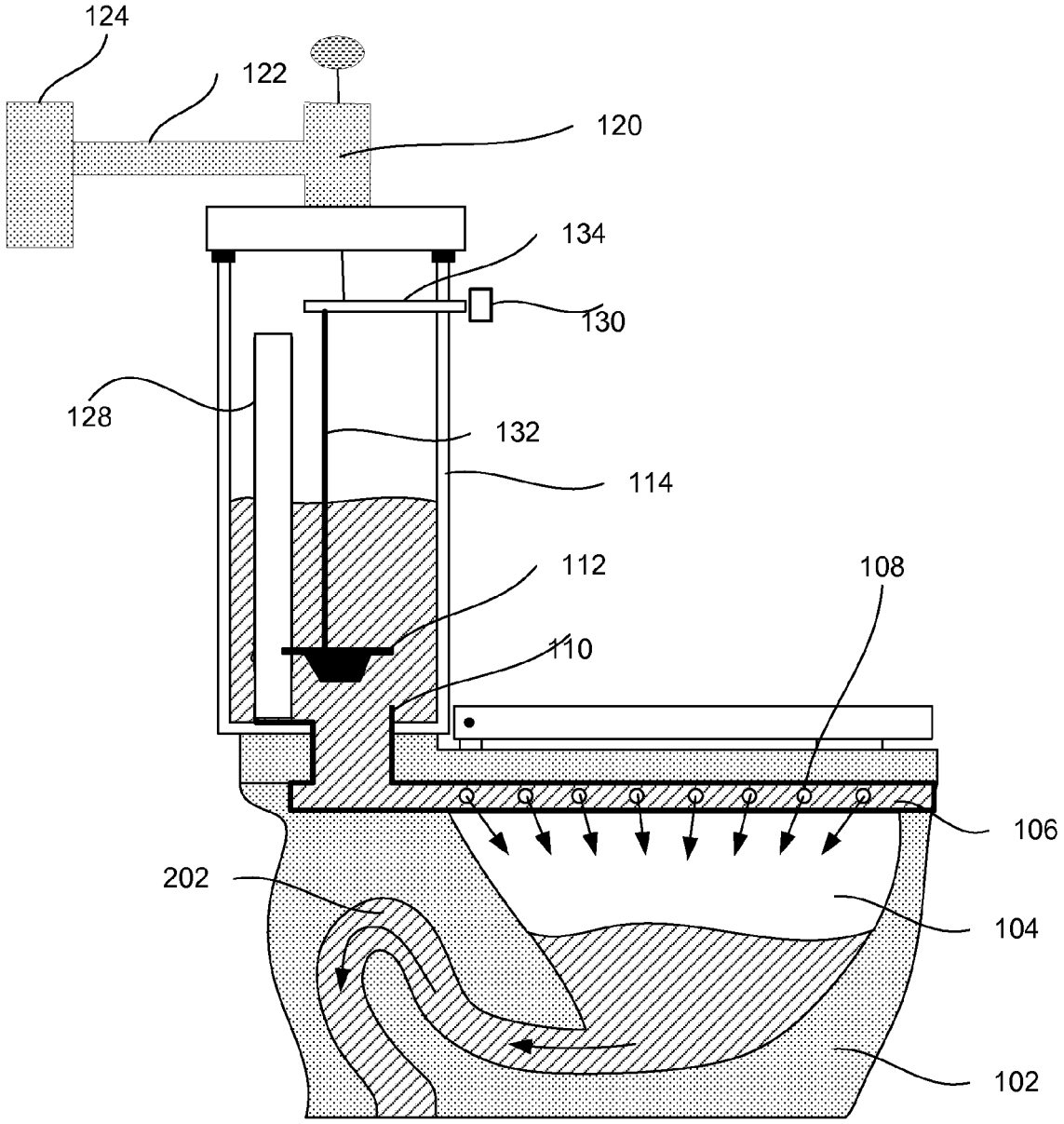
FIG. 2 is schematic illustration of a ventilated toilet system with a ventilation valve during flushing of its bowl cavity, in accordance with certain embodiments.

FIG. 2 is schematic illustration of a ventilated toilet system with a ventilation valve during flushing of its bowl cavity, in accordance with certain embodiments.

As noted above, a ventilated toilet system illustrated in FIG. 2 may be the same as or similar to the ventilated toilet system illustrated in FIG. 1. The flush handle 130 may be connected to the ventilation valve 120 and to the drainage valve 112. The flush handle 130 may be connected to the drainage valve 112 via the trip lever 134 and the chain 132. Engaging the flush handle 130 may firstly open the ventilation valve 120 into a room environment and the air may flow from the room environment to the toilet tank 114. Opening the ventilation valve 120 may also cause the ventilation fan 124 to remove the air from the room environment instead of the air from the toilet tank 114 while the bowl cavity 104 is flushed. When further engaging the flush handle 130, the drainage valve 112 may be lifted above the drainage tube 110, which allows the water to escape from the toilet tank 114 through the one or more openings 108 in the toilet bowl 102 and through the flush passage 106 into the bowl cavity 104. The water then escapes from bowl cavity 104 through a water trap 202. While flushing the bowl cavity 104, the air may flow from the room environment.

The ventilation fan 124 may be turned off during flushing and a pressure inside the toilet tank 114 may be equilibrated with that in the environment. In certain embodiments, the ventilation fan 124 may remain on after flushing the toilet bowl 102 for a predetermined period of time.

Exhaust from the ventilated toilet system may be filtered and provided back into the environment where the ventilated toilet system is positioned or exhausted to some outside environment. For example, an exhaust line may be connected to the siphon line connected to the sewer line of the ventilated toilet system.

In certain embodiments, the toilet ventilation system may include a control system that may control operation of the ventilation fan 122. The control system may be used to turn the ventilation fan 122 on and off and, in certain embodiments, control the speed of the ventilation fan 122. Output of the control system may be connected to exhaust fan 122. Furthermore, the control system may be used to control the ventilation valve 120 for equilibrating the pressure inside the toilet tank 114 with the environment. The ventilation valve 120 may be open during flushing to allow the water to drain from the toilet tank 114. Unlike tanks of conventional toilets that have rather open communication with the environment, the toilet tank 114 of the toilet ventilation system may be substantially airtight. Therefore, some air communication with the environment may need to be established during flushing.

The control system may receive inputs from the trip lever 134, which controls position of the drainage valve 112. For example, when the trip lever 134 lifts the drainage valve 112 during flushing, the control system may simultaneously shut down the ventilation fan 124 and, in certain embodiments, open the ventilation valve 120. In the same or other embodiments, an input to the control system may be provided by a proximity sensor. The proximity sensor may be used for detecting presence of a user within a predetermined range from the toilet bowl 102 or the toilet tank 114. The control system may then use this input to turn on the ventilation fan 124 when the user is present within the predetermined range. The control system may also include a switch for turning on and off the ventilation fan 124 by the user and override other inputs. In certain embodiments, the control system may be configured to turn on the ventilation fan 124 for a predetermined period of time after flushing the toilet ventilation system.

Figure 3:
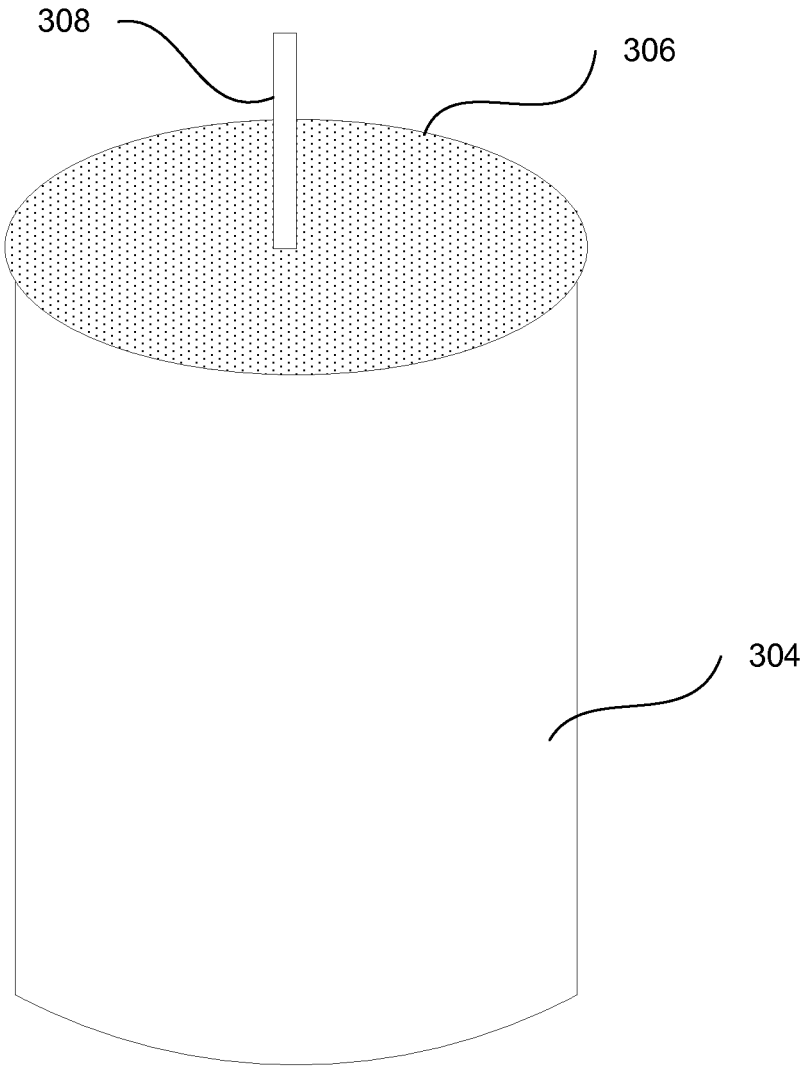
FIG. 3 is a schematic illustration of a ventilation valve in a closed position, in accordance with certain embodiments.

FIG. 3 is a schematic illustration of a ventilation valve in a closed position, in accordance with certain embodiments.

The ventilation valve may include a casing 304. The casing 304 may be made of any metal or plastic material. The casing 304 may also be constructed in any shape and size. The ventilation valve may include a pin 308 and a plate 306 operatively coupled to the pin 308.

Figure 4:
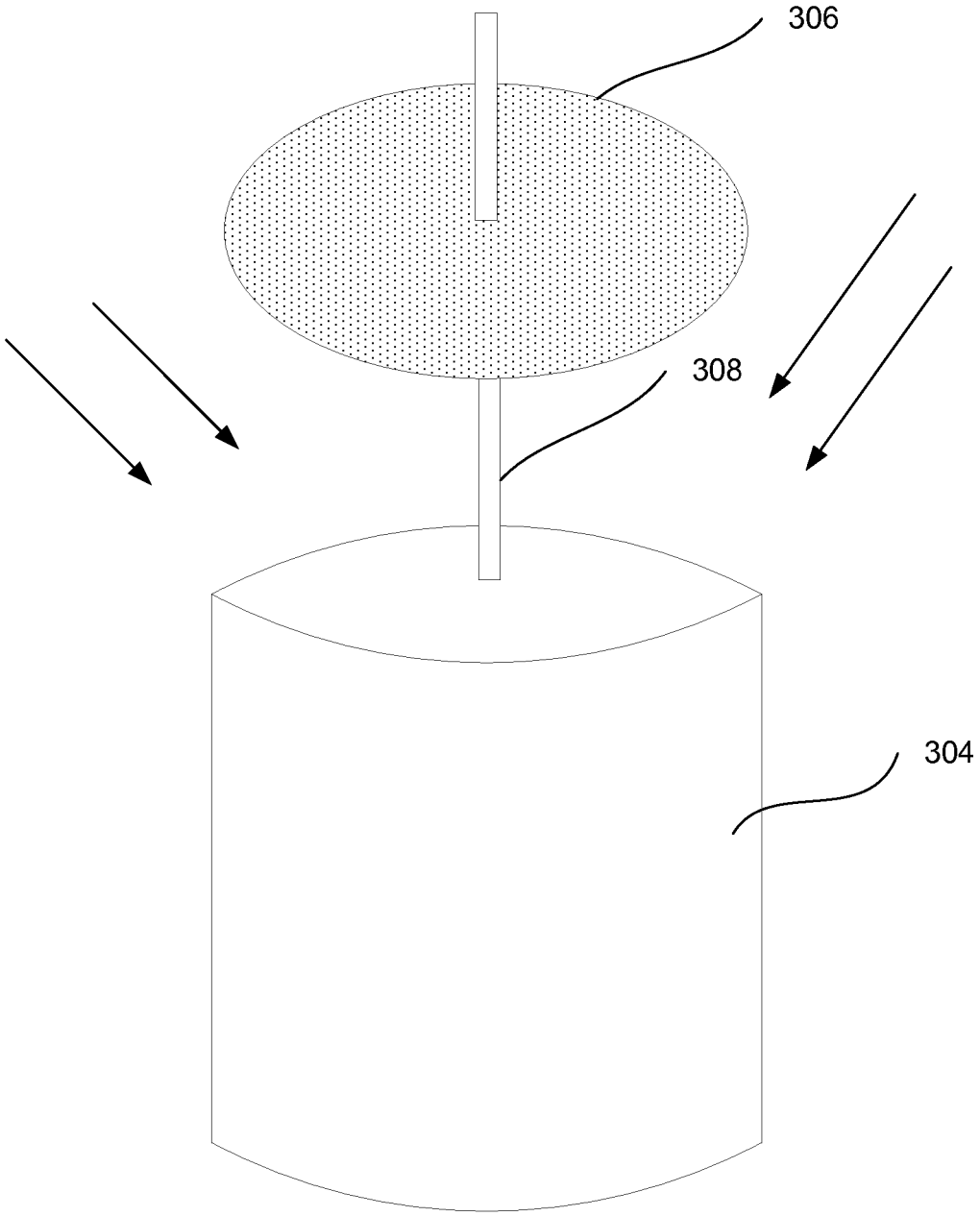
FIG. 4 is a schematic illustration of a ventilation valve in an open position, in accordance with certain embodiments.

FIG. 4 is a schematic illustration of a ventilation valve in an open position, in accordance with certain embodiments.

As shown in FIG. 4, when the ventilation valve is in an open position, the plate 306 coupled to the pin 308 may be lifted, thereby allowing the air to flow into the ventilation valve. In certain embodiments, the ventilation valve may include a ventilation valve connector configured to rigidly couple the ventilation valve to a flush handle. Engaging the flush handle may cause the ventilation valve connector to lift the plate 306 coupled to the pin 308.

Figure 5:
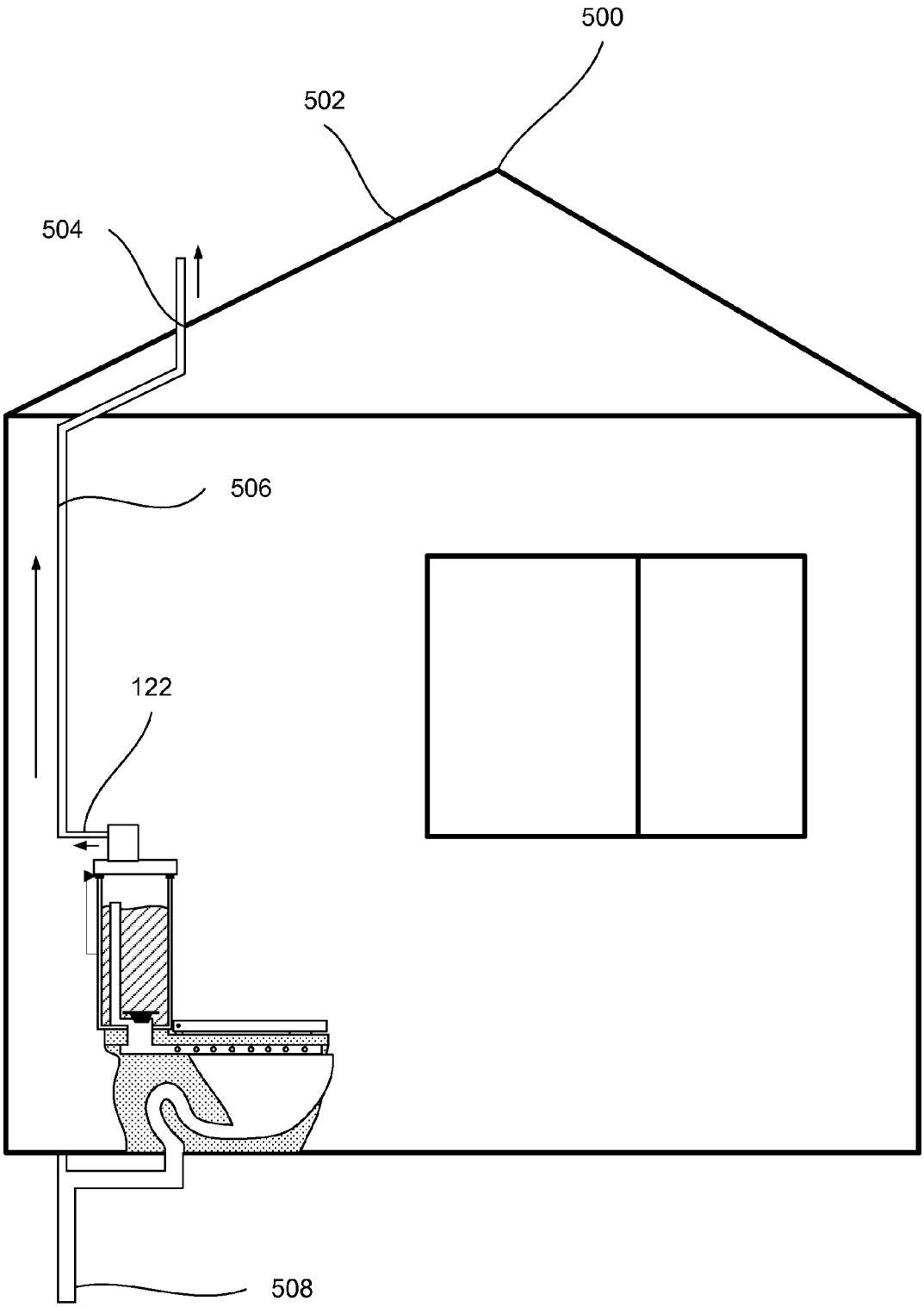
FIG. 5 is a schematic illustration of a ventilated toilet system positioned in a building, in accordance with certain embodiments.

FIG. 5 is a schematic illustration of a ventilated toilet system positioned in a building, in accordance with certain embodiments.

Specifically, FIG. 5 illustrates a ventilated toilet system positioned in a building having a sewer line 508 and a siphon line 506. One end of the siphon line 506 may be connected to the sewer line 508 to prevent air traps in the sewer line 508. Another end of the siphon line 506 may extend to a roof 502 of a building and form a vent 504. The air conduit 122 may be connected to the siphon line 506 and all odors exhausted through the air conduit 122 may flow through the siphon line 506 and the vent 504. In other embodiments, the air conduit 122 of a ventilated toilet system may be connected to a facility exhaust system, such as a shower vent or any other vents available.

Figure 6:
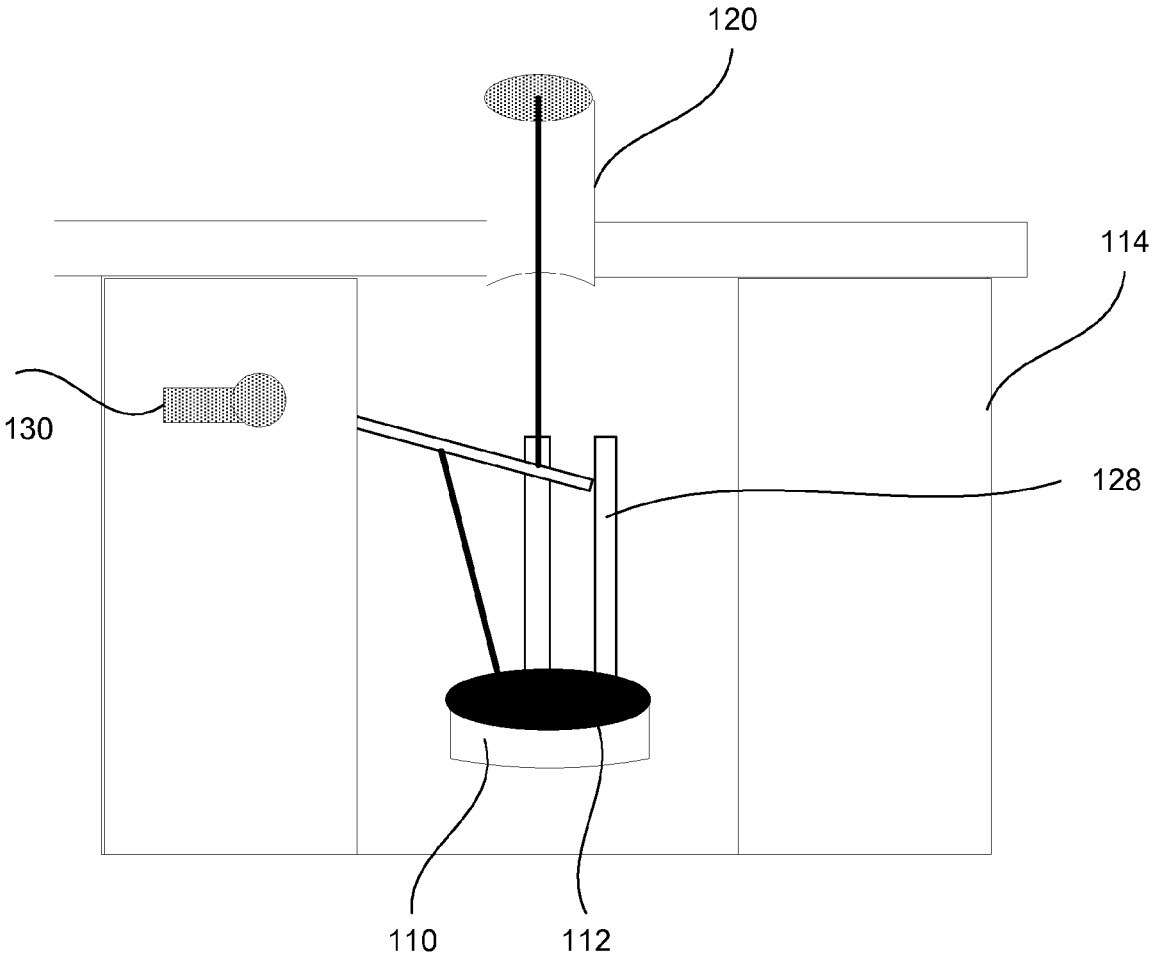
FIG. 6 is a schematic illustration of a toilet tank with a ventilation valve and a drainage valve in closed positions, in accordance with certain embodiments.

FIG. 6 is a schematic illustration of a toilet tank with a ventilation valve and a drainage valve in closed positions, in accordance with certain embodiments.

As shown in FIG. 6, when the flush handle 130 of the toilet tank 114 is disengaged, the drainage valve 112 may be positioned on the drainage tube 110, thereby preventing water from draining from the toilet tank 114. When the drainage valve 112 and the ventilation valve 120 are in closed positions, air may be drawn by a ventilation fan into one or more openings of a toilet bowl through the one or more overflow tubes 128 of the toilet tank 114.

Figure 7:
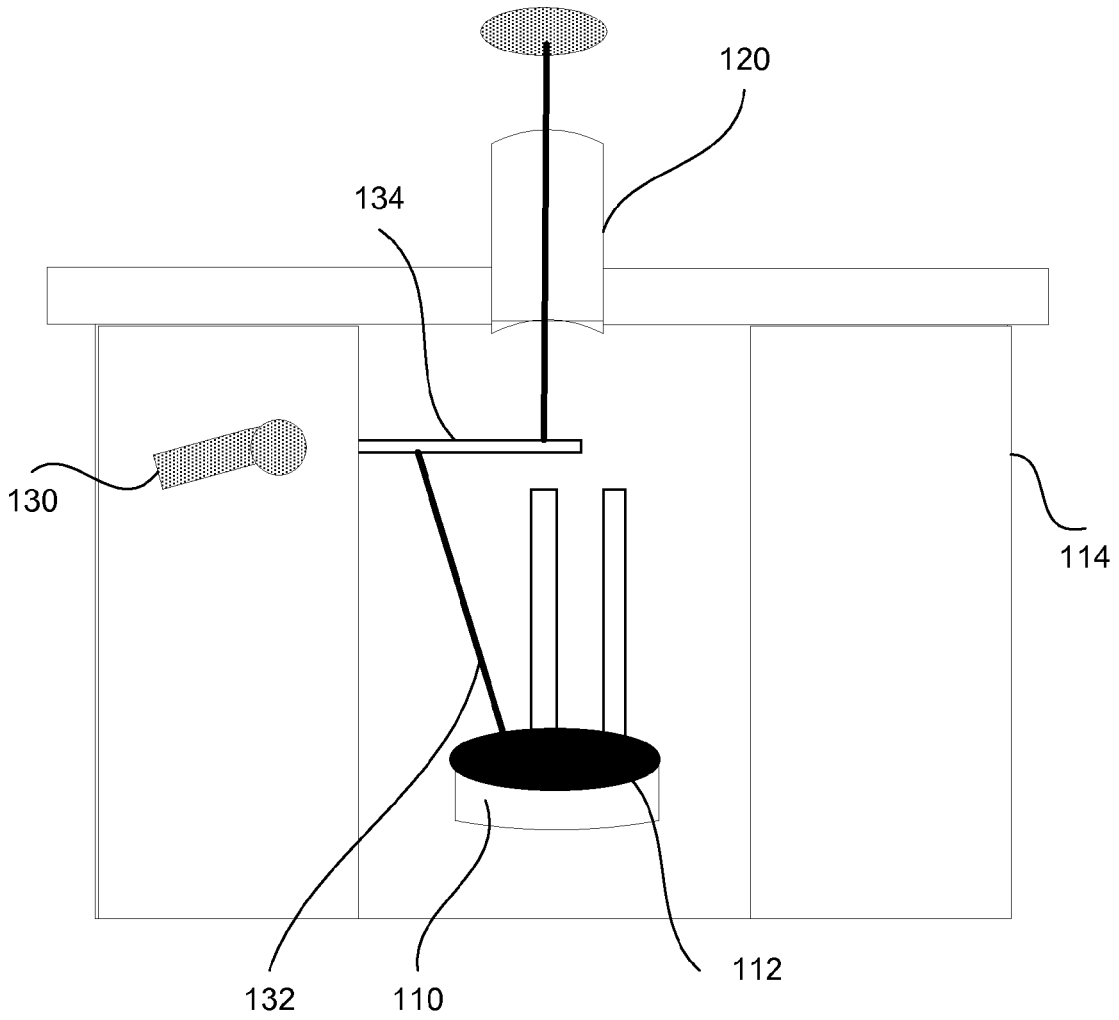
FIG. 7 is a schematic illustration of a toilet tank with a ventilation valve in an open position and a drainage valve in a closed position, in accordance with certain embodiments.

FIG. 7 is a schematic illustration of a toilet tank with a ventilation valve in an open position and a drainage valve in a closed position, in accordance with certain embodiments.

As specified above in FIG. 1, the flush handle 130 may be connected to the ventilation valve 120 and to the drainage valve 112. The flush handle 130 may be connected to the drainage valve 112 via the trip lever 134 and the chain 132. Engaging the flush handle 130 may open the ventilation valve 120 into a room environment. When the ventilation valve 112 is open, the air may flow from a room environment into the toilet tank 114.

Figure 8:
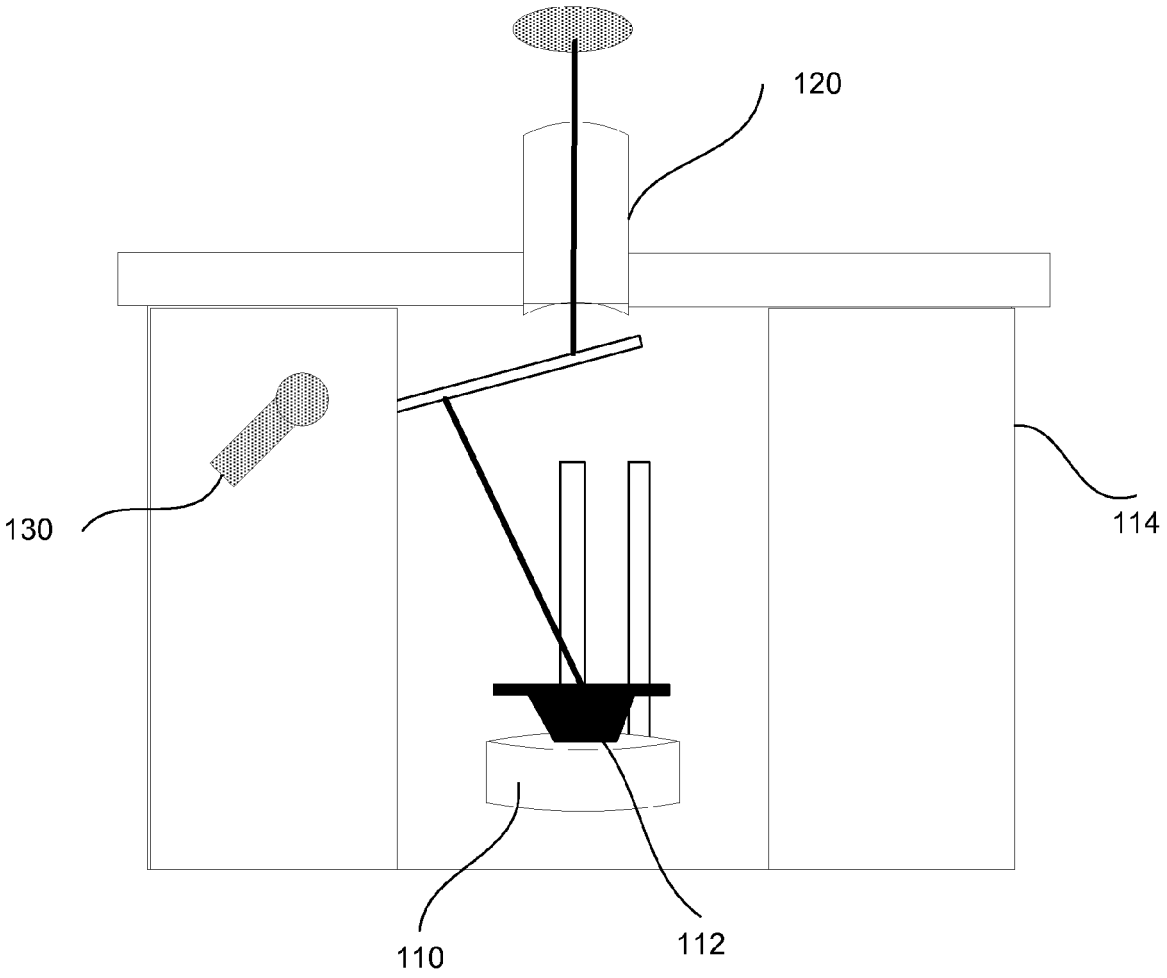
FIG. 8 is a schematic illustration of a toilet tank with a ventilation valve and a drainage valve in open positions, in accordance with certain embodiments.

FIG. 8 is a schematic illustration of a toilet tank with a ventilation valve and a drainage valve in open positions, in accordance with certain embodiments.

Engaging the flush handle 130 may first open the ventilation valve 120 into a room environment. When further engaging the flush handle 130, the drainage valve 112 may be lifted above the drainage tube 110, which allows the water to escape from the toilet tank 114 through the drainage tube 110 and one or more openings of a toilet bowl into a bowl cavity.

Although the foregoing concepts have been described in some detail for purposes of clarity of understanding, it will be apparent that certain changes and modifications may be practiced within the scope of the appended claims. It should be noted that there are many alternative ways of implementing the processes, systems, and apparatuses. Accordingly, the present embodiments are to be considered as illustrative and not restrictive.

What is claimed is:

1. A toilet ventilation system comprising:

an air conduit configured to connect a toilet tank and a ventilation fan, wherein the air conduit is to facilitate removal of air from a toilet bowl moved into the toilet tank via one or more overflow tubes;

a ventilation valve operatively coupled to the air conduit and configured to open into a room environment;

a drainage valve operatively coupled to a flush handle, wherein the flush handle controls a position of the drainage valve; and a ventilation valve connector configured to rigidly couple the ventilation valve to a lift arm associated with the flush handle, wherein engaging the flush handle activates the ventilation valve, wherein the activating includes at least a partial opening stage and a complete opening stage, the partial opening stage resulting in the ventilation valve connector opening the ventilation valve into the room environment with the drainage valve closed, and the complete opening stage resulting in the ventilation valve connector opening the ventilation valve and the drainage valve.

2. The toilet ventilation system of claim 1, wherein opening of the ventilation valve causes the ventilation fan to remove the air from the room environment instead of the air from the toilet tank while the toilet bowl is flushed.

3. The toilet ventilation system of claim 1, wherein the one or more overflow tubes are connected to the toilet bowl via a drainage tube.

4. The toilet ventilation system of claim 3, wherein the drainage tube connected to the toilet bowl via one or more openings in the toilet bowl.

5. The toilet ventilation system of claim 1, further comprising a drainage connector configured to operatively couple the lift arm to the one or more overflow tubes.

6. The toilet ventilation system of claim 1, further comprising a filter to clean the air removed from the toilet bowl.

7. The toilet ventilation system of claim 1, wherein the ventilation fan includes a built-in exhaust fan.

8. The toilet ventilation system of claim 1, wherein the ventilation fan remains on after flushing the toilet bowl for a predetermined period of time.

9. The toilet ventilation system of claim 1, wherein the ventilation fan is turned on based on a proximity sensor sensing a user within a predetermined distance.

10. A toilet ventilation system comprising:

an air conduit configured to connect a toilet tank and a ventilation fan, wherein the air conduit is to facilitate removal of air from a toilet bowl moved into the toilet tank via one or more overflow tubes, the one or more overflow tubes being connected to the toilet bowl via a drainage tube, the drainage tube being connected to the toilet bowl via one or more openings in the toilet bowl;

a ventilation valve operatively coupled to the air conduit and configured to open into a room environment;

a drainage valve operatively coupled to a flush handle, wherein the flush handle controls a position of the drainage valve;

a ventilation valve connector configured to rigidly couple the ventilation valve to a lift arm associated with the flush handle, wherein engaging the flush handle activates the ventilation valve, wherein the activating includes at least a partial opening stage and a complete opening stage, the partial opening stage resulting in the ventilation valve connector opening the ventilation valve into the room environment with the drainage valve closed, the opening of the ventilation valve causing a pause in the removal of the air from the toilet bowl, and the complete opening stage resulting in the ventilation valve connector opening the ventilation valve and the drainage valve; and a drainage connector configured to operatively couple the lift arm to the one or more overflow tubes.

* * * * *